US008651612B2

(12) United States Patent
Lindenaar

(10) Patent No.: US 8,651,612 B2
(45) Date of Patent: Feb. 18, 2014

(54) METHOD FOR DETERMINING A VELOCITY OF AN OBJECT IN A PRINTING SYSTEM

(75) Inventor: Daniel J. W. Lindenaar, Venlo (NL)

(73) Assignee: OCE Technologies B.V., Venlo (NL)

( * ) Notice: Subject to any disclaimer, the term of this patent is extended or adjusted under 35 U.S.C. 154(b) by 126 days.

(21) Appl. No.: 13/478,962

(22) Filed: May 23, 2012

(65) Prior Publication Data

US 2012/0249657 A1 Oct. 4, 2012

Related U.S. Application Data

(63) Continuation of application No. PCT/EP2010/068212, filed on Nov. 25, 2010.

(30) Foreign Application Priority Data

Nov. 30, 2009 (EP) ..... 09177432

(51) Int. Cl.
*B41J 29/38* (2006.01)

(52) U.S. Cl.
USPC ..... 347/16; 347/37; 318/602

(58) Field of Classification Search
USPC ..... 347/16, 37; 318/602
See application file for complete search history.

(56) References Cited

U.S. PATENT DOCUMENTS

| | | | |
|---|---|---|---|
| 4,416,560 | A | 11/1983 | Wood et al. |
| 5,889,534 | A | 3/1999 | Johnson et al. |
| 2007/0086820 | A1 | 4/2007 | Goss et al. |

FOREIGN PATENT DOCUMENTS

| | | | |
|---|---|---|---|
| EP | 1 674 278 | B1 | 6/2006 |
| JP | 2008-132707 | A | 6/2008 |

*Primary Examiner* — Julian Huffman

(74) *Attorney, Agent, or Firm* — Birch, Stewart, Kolasch & Birch, LLP

(57) ABSTRACT

In a method for determining a velocity of an object in a printing system, a reference pattern is moved, in particular in a substantial linear movement or in a rotational movement, relative to an fixed reference point independent of the object. A first sensor, configured to have substantially the same velocity as said object with respect to said reference pattern, provides a sensor signal based on the sensed reference pattern. The velocity of the object with respect to said fixed reference point is determined based on the determined velocity of said reference pattern with respect to said fixed reference point, and based on the sensor signal. The movement of the reference pattern enables improved accuracy of the determination of the velocity of the object, in particular for a slow moving object.

17 Claims, 8 Drawing Sheets

METHOD FOR DETERMINING A VELOCITY OF AN OBJECT IN A PRINTING SYSTEM

This application is a Bypass Continuation of PCT International Application No. PCT/EP2010/068212 filed on Nov. 25, 2010, which claims priority under 35 U.S.C §119(a) to Patent Application No. 09177432.3 filed in Europe on Nov. 30, 2009, all of which are hereby expressly incorporated by reference into the present application.

FIELD OF THE INVENTION

The invention relates to a method for determining a velocity of an object in a printing system. The invention also relates to an apparatus for determining a velocity of an object in a printing system. The invention also relates to a printing system comprising such an apparatus for determining a velocity of an object in the printing system.

BACKGROUND OF THE INVENTION

In an inkjet printing system a carriage is moved in a scanning movement over a recording medium. The carriage comprises at least one inkjet print head. Typically the velocity of a moving carriage is determined by measuring the movement of the carriage with respect to a reference pattern, for example a linear code strip. The code strip is fixed to the carriage support frame and extends in the scanning direction of the carriage. Such a code strip is known for example from EP 1674278.

The reference pattern comprises a plurality of markers, the markers usually being mutually equidistant. The resolution of the reference pattern is selected in accordance with the criteria of the printing application and in particular in accordance with the printing resolution of the image. Typically for a print resolution in the scanning direction of, for example, 600 dots-per-inch (dpi) a reference pattern is used, which reference pattern has a marker resolution of a division sum of the print resolution divided by an integer number.

The markers of the reference pattern are detectable by a sensor. Said sensor is fixed to the carriage and is arranged such that it is able to sense the markers of the reference pattern. The sensor provides a sensor signal based upon the detection of the markers in the reference pattern.

The frequency that the sensor senses a marker depends on the movement of the sensor relative to the markers in the reference pattern. The marker frequency is reduced in case the movement of the object is decelerated. As a result the information frequency in the sensor signal is reduced. Consequently the frequency of determining the velocity decreases when the velocity of the carriage decreases.

In any position of the object, where the sensor does not sense a marker of the pattern, the actual velocity and position of the object is unknown. In known printing systems the position and velocity of a carriage when moving between subsequent markers is estimated based upon a previous determination of the velocity of the object.

Thus the frequency of determining the velocity effects the accuracy of the determination of the velocity. And a lower frequency reduces the accuracy of the determination.

The disadvantage of methods for determining a velocity of an object in a printing system is the inaccuracy in determining the velocity of the object, in particular when the object is moving slow relatively to the reference pattern.

SUMMARY OF THE INVENTION

It is an object of the present invention to provide a method with an improved accuracy of determining the velocity of the object in a printing system, including for a slow moving object.

According to the invention, this object is achieved by a method for determining a velocity of an object in a printing system, the printing system comprising a fixed reference point, a reference pattern, independently movable with respect to said fixed reference point, wherein the object is independently movable with respect to said fixed reference point and with respect to the reference pattern, a first sensor, configured to have substantially the same velocity as said object with respect to said reference pattern and configured such that in operation the reference pattern is sensed by said sensor, comprising the following steps:

a) moving said reference pattern relative to said fixed reference point independent of said object, b) determining the velocity of said reference pattern with respect to said fixed reference point, c) sensing said reference pattern using said first sensor, d) providing a sensor signal based on said sensed reference pattern, and e) determining the velocity of said object relative to said fixed reference point based on the determined velocity of said reference pattern with respect to said fixed reference point, and based on said sensor signal.

The movement of the reference pattern enables improved accuracy of the determination of the velocity of the object. The reference pattern is moved relative to the fixed reference point or the stationary frame. The object is independently movable with respect to said fixed reference point and with respect to the reference pattern. The first sensor has substantially the same velocity as said object with respect to said reference pattern. The first sensor senses the reference pattern. The frequency at which the sensor senses the reference pattern may be adjusted by moving the reference pattern with a certain direction and velocity. As a result of the moving reference pattern said frequency may become independent of a) the resolution of the markers of the reference pattern and b) the movement of the object. The method provides improved accuracy in determination of the velocity of said object.

This method is in particular advantageous in case the object is moving slow relative to a regular operational velocity. This method is also advantageous in case the velocity of the object in operation is changing frequently. Using the method of the present invention the velocity of a scanning carriage in a printing system may be determined accurately for all velocities during operation.

The printing system may be any printing system. For example inkjet printing, electro photographic printing, direct inductive printing or any other image forming system. The printing system may also include other means for storage, for transport and/or for finishing of the recording medium.

The movable objects may be any movable object in the printing system. For example a carriage, which comprises at least one print head. Another movable object in a printing system is a transport roller, which may be rotatably movable. Yet another typical movable object is an imaging member, such as an imaging belt or imaging drum, which may be rotatable and/or linear movable. Yet another movable object is a receiving medium.

The fixed reference point may be, e.g., a fixed point of the frame of the printing system. The fixed reference point may also be a position in an independent axes system (e.g. an orthogonal axes system). In any way the fixed reference point is meant as reference point with respect to both a) the movement of the reference pattern in the printing system, b) the movement of the object in the printing system and c) a position of the printing system. The fixed reference point is as such used as reference position for both movements in order to determine the velocity of the object in the printing system.

The reference pattern comprises one marker or a plurality of markers. The plurality of markers may be arranged having a regular pattern in distances between adjacent markers. Preferably the reference pattern comprises a plurality of markers which are arranged at mutually equal distance.

The first sensor may be fixed to the object or may be connected to a position of the object. The first sensor may be connected to the object such that the first sensor is moving in the same direction and with the same velocity as the object. The first sensor may also be connected to the object such that the first sensor is moving with the same velocity as the object, however moving with a different direction as the movement of the object.

In step a) the reference pattern is moved independent of the movement of the object. The reference pattern may be moved independent of the movement of the object in any direction. For example in a substantial linear direction, in a rotational movement, in a combination of a linear direction and rotational movement, in a scanning movement, in a helical direction, or any other direction.

The reference pattern may be moved with a substantially constant velocity. The velocity of the reference pattern may also be changed. The movement direction and/or velocity of the reference pattern may be adjusted in response to the movement direction and/or velocity of the object.

In step b) the velocity of the reference pattern with respect to the fixed reference point is determined. Said velocity may be determined by measuring the movement of the markers of the reference pattern. The movement of the reference pattern may be determined by a second sensor. The second sensor in operation is able to sense the markers of the reference pattern. The second sensor is preferably stationary with respect to the fixed reference point.

Alternatively the velocity of the reference pattern with respect to the fixed reference point may be determined by accurately controlling the movement of the reference pattern. The movement may be accurately controlled by driving means, which means are configured for accurately moving the reference pattern. Preferably the driving means is configured such that the reference pattern attains a pre-selected velocity. Furthermore in operation the velocity of the reference pattern may be accurately maintained by the driving means at said pre-selected velocity.

In step c) the first sensor senses said reference pattern. The first sensor may sense the reference pattern in any way. For example the markers of the reference pattern may be sensed optically, electrically, magnetically, mechanically, or the like. The first sensor and the markers of the reference pattern are selected in order that the markers may be sensed by the first sensor.

In step d) the first sensor provides a sensor signal based on said sensed reference pattern. The sensor signal comprises information about the sensed reference pattern. The sensor signal may be any digital signal or analogous signal.

The sensor signal may comprise information of the velocity of the sensed reference pattern relative to the first sensor, or may comprise data corresponding to a frequency of at least a part of the plurality of markers of the sensed reference pattern, or may comprise information corresponding to a marker of the sensed reference pattern.

In step e) the velocity of said object relative to said fixed reference point is determined. The determination of the velocity of the object with respect to said fixed reference point is based on:

a) the determined velocity of the reference pattern with respect to said fixed reference point as determined in step b); and b) the sensor signal as provided in step d).

The determination is based on the velocity of the object relative to the reference pattern and on the velocity of the reference pattern relative to said fixed reference point.

The velocity of the object relative to the reference pattern may be directly provided in the sensor signal or may be calculated from the information in the sensor signal.

The velocity of the object relative to the reference pattern may be calculated based on a known distance between adjacent markers in the reference pattern. Alternatively the calculated may be based on a known relation between a frequency, provided by the sensor signal, and a velocity of the object relative to the reference pattern.

In case in step b) the velocity of the reference pattern relative to said fixed reference point is measured by a second sensor, the velocity of the object relative to said fixed reference point may be based on a signal provided by the second sensor; the sensor signal of the second signal comprising information corresponding to the sensing of the reference pattern by the second sensor.

In an embodiment of the present invention, step a) comprises moving the reference pattern in a substantial linear movement. This embodiment is especially useful for determining a velocity of a linear moving object, such as a reciprocating scanning carriage in an inkjet printing system.

In another embodiment of the present invention, step a) comprises moving the reference pattern in a rotational movement. This embodiment is in particular useful for determining a velocity of a rotationally moving object, such as a transport roller. More in particular the embodiment provides advantages for a stepwise rotatably moving object.

In another embodiment of the present invention, step b) comprises providing a second sensor and determining the velocity of said reference pattern with respect to said fixed reference point by said second sensor. This embodiment is in particular useful for determining a velocity of a moving reference pattern. This embodiment provides the advantage that the control of the velocity of the reference pattern by driving means does not have to be very accurate.

In another embodiment of the present invention, step b) comprises providing driving means for controlling the velocity of said reference pattern with respect to said fixed reference point, wherein the driving means are configured such that reference pattern attains a pre-selected velocity. This embodiment is in particular useful for determining a velocity of a moving reference pattern. In this embodiment the control of the velocity of the reference pattern by the driving means is very accurate. A desired velocity of the moving reference pattern may be pre-selected. The velocity may be pre-selected based on a pre-estimated velocity of the object with respect to said fixed reference point.

In another embodiment of the present invention, step e) comprises determining a time interval between a sub sequential of sensor signals of said first sensor. This embodiment is in particular useful for determining a velocity of an object in case the sensor signal is provided at each time that the first sensor senses a marker of the reference pattern. The velocity of the object with respect to the reference pattern may be based on the time interval between a sub sequential of sensor signals and the known distance between subsequent markers of the reference pattern.

In another embodiment of the present invention, step a) comprises adapting the movement of said reference pattern with respect to said fixed reference point relative to the movement of the object. This embodiment is in particular useful for determining a velocity of an object, which object is not moving with a constant velocity during operation. In particular the embodiment is useful for an object which is intended to be stopped at a pre-selected position during operation.

In a further embodiment of the present invention, step a) comprises moving the reference pattern in a substantial opposite direction of the movement of the object. This embodiment is in particular useful for accurately determining a velocity of an object. By moving the reference pattern in a substantial opposite direction of the movement of the object the velocity of the object with respect to the reference pattern is increased compared to the velocity of the object with respect to the fixed reference point. As a result the frequency of the sampling of markers of the reference pattern is increased. So the frequency of the sampling of the velocity may also be increased. For slow moving objects with respect to the fixed reference point this embodiment is in particular advantageous.

In a further embodiment of the present invention, the method comprises additional steps f) providing a homing point on said reference pattern, g) sensing the homing position by first and second sensor, and h) determining the position of the object with respect to the fixed reference point. This embodiment is in particular useful for an object which is intended to be stopped at a pre-selected position during operation.

In another aspect of the present invention, the invention relates to an apparatus for determining a velocity of an object in a printing system, the apparatus system comprising an fixed reference point, a reference pattern, which is independently movable with respect to said fixed reference point and with respect to the object, a first sensor and a control unit, wherein the object is independently movable with respect to said fixed reference point and with respect to the reference pattern, the first sensor being configured to have substantially the same velocity as said object with respect to said reference pattern and configured to sense the reference pattern and provide a sensor signal to the control unit, which control unit is configured to receive and process the sensor signal of the first sensor and thereby determining the velocity of said object relative to said fixed reference point based on the sensor signal of the first sensor and on a determined velocity of the reference pattern with respect to said fixed reference point.

Hence, an apparatus configured for performing the method according to the present invention is provided.

In the apparatus according to an embodiment, the object is movable in a substantial linear movement and said velocity is the velocity in said linear movement. This embodiment is in particular useful for a scanning carriage, a recording medium or the like.

In the apparatus according to another embodiment, the object is rotatable around at least one axes and said velocity is the velocity in said rotational movement. This embodiment is in particular useful for a rotating roller, such as a driven transport roller for transporting a recording medium.

In the apparatus according to a further embodiment, said reference pattern is an endless pattern. This embodiment provides the advantage that the reference pattern may be continuously moved in one direction. The endless pattern enables a continuously determining of the velocity of the object.

In the apparatus according to another embodiment, a second sensor is provided, which second sensor is stationary with respect to said fixed reference point, and the velocity of said reference pattern with respect to said fixed reference point is determined by said second sensor. This embodiment is in particular useful for determining a velocity of a moving reference pattern. This embodiment provides the advantage that the control of the velocity of the reference pattern by driving means does not have to be very accurate.

In the apparatus according to another embodiment, said first sensor is an optical sensor and said reference pattern is an optical readable pattern. This embodiment enables the use of relatively simple and cheap sensors and reference patterns.

In the apparatus according to another embodiment, said first sensor is a magnetical sensor and said reference pattern is a magnetically readable pattern. This embodiment enables the use of relatively simple and cheap sensors and reference patterns.

In the apparatus according to another embodiment, said reference pattern comprises a homing point, wherein said homing point is distinguishable from said reference pattern for said first and optionally second sensor. This embodiment may be used for determining the position of the object. This embodiment is in particular useful for an object which is intended to be stopped at a pre-selected position during operation.

BRIEF DESCRIPTION OF THE DRAWINGS

Hereinafter, the present invention is elucidated with reference to the appended drawings showing non-limiting embodiments and wherein.

DETAILED DESCRIPTION OF THE INVENTION

Figure 1:
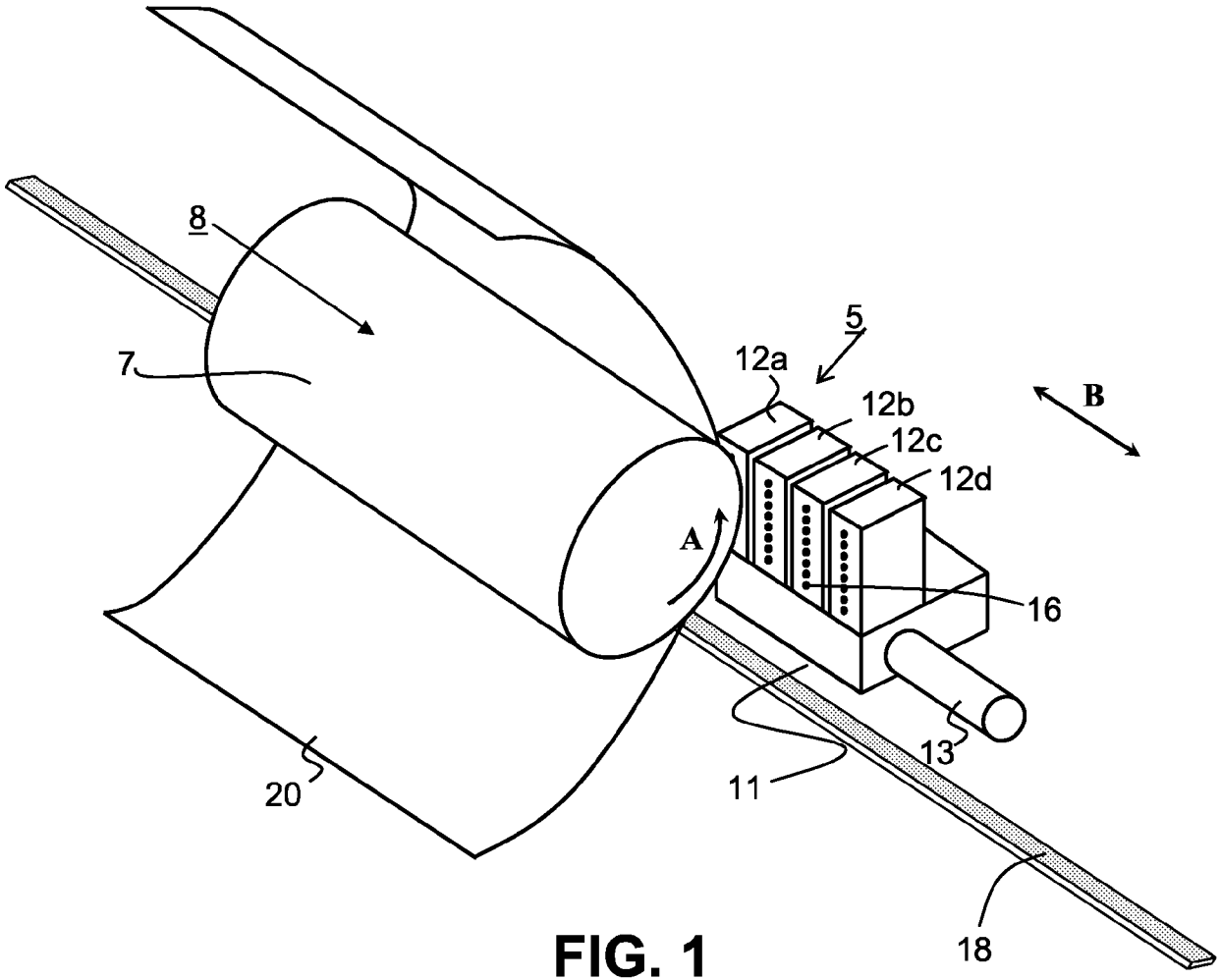
FIG. 1 shows a schematic perspective view of an inkjet printing device in accordance with the present invention.

In the drawings, same reference numerals refer to same elements. FIG. 1 illustrates an inkjet printing system 2 in accordance with the present invention, wherein a curable hot-melt ink may be applied on a recording medium 20. The printing system 2 comprises a medium advance means 8 and a recording means 5.

In the illustrated example, the recording medium 20, e.g. paper or any other suitable medium for image-wise receiving ink drops from the inkjet printer 2, is movable by means of the medium advance means 8. In the illustrated embodiment, the medium advance means comprises a platen 7. The medium advance means 8 are configured to move the medium 20 with respect to the recording means 5 in a direction A, which is hereinafter referred to as medium advance direction A.

The recording means 5 comprises four print heads 12*a*-12*d*, each comprising a set of nozzles 16. The print heads 12*a*-12*d* are configured to eject ink drops from the nozzles 16 such that the ink drops impinge on the medium 20 at a substantially predetermined position. The four print heads 12*a*-12*d* may each be configured to eject ink of a same color, e.g. black ink to generate a black image on the recording medium 20, or the print heads 12*a*-12*d* may each eject ink of a different color, e.g. cyan, magenta, yellow and black (CMYK), for generating a full color image on the recording medium 20.

The four print heads 12*a*-12*d* are arranged on a carriage 11 which is movably supported on a guide rail 13. Thus, the carriage 11 is movable in a scanning direction B. Hence, the four print heads 12*a*-12*d* are movable with respect to the recording medium 20 in said scanning direction B. By suitably controlling the movement of the carriage 11 and the movement of the medium 20 in the medium advance direction A, while suitably controlling the ejection of ink drops from the nozzles 16 of the print heads 12*a*-12*d*, the printer 2 is enabled to generate an image on the recording medium 20. Such a printing method is well known in the art and is therefore not further elucidated herein.

A reference pattern 18 is arranged in parallel to the guide rail 13 in the scanning direction B of the carriage 11. The reference pattern 18 is movable arranged with respect to a stationary frame (not shown) of the printing system 2. The reference pattern 18 is moved according to the present invention.

The method for determining a velocity of an object in a printing system will be explained in detail in the FIGS. 2-5C.

It is noted that the method according to the present invention is not limited to use in an embodiment of a printer according to the exemplary, schematically illustrated printer of FIG. 1, but may as well be employed in any other suitably configured printing system 2, such as a toner printing system. The method according to the present invention may as well be employed for paper handling means such as paper transport rollers in paper finishing parts of a printing system.

Figure 2:
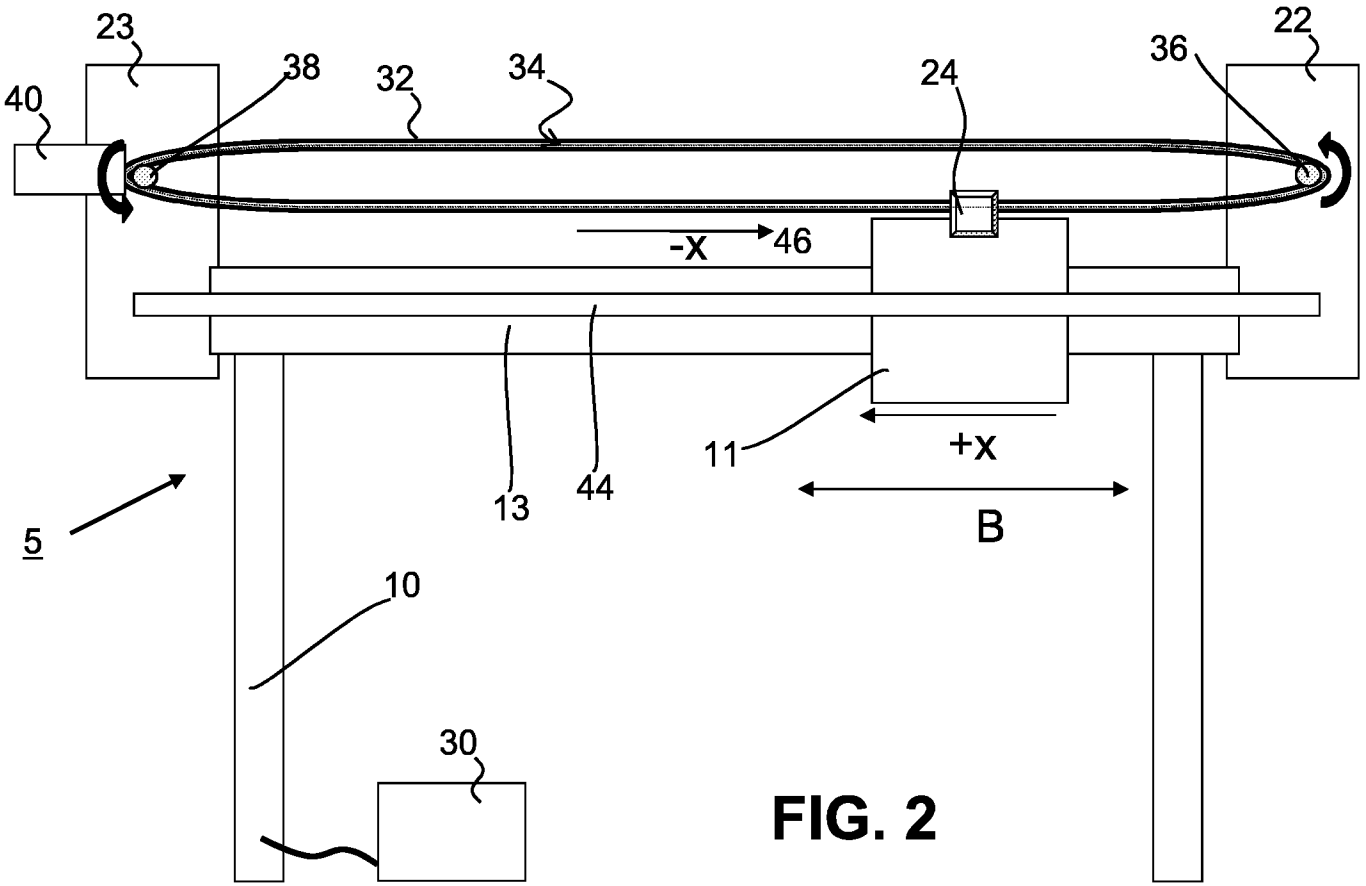
FIG. 2 shows a front schematic view of a first embodiment of the method in accordance with the present invention.

FIG. 2 illustrates a front schematic view of a first embodiment of a method in accordance with the present invention for determining the velocity of a carriage.

An endless belt 32, which comprises a reference pattern 34, is arranged in parallel to the scanning direction B of the carriage 11. The reference pattern 34 comprises markers at a fixed and constant distance.

A free rotating roller 36 and a transport roller 38 supports the endless belt at both sides of the guide rail 13. The free rotating roller 36 is supported by the upper frame part 22 and the transport roller 38 is supported by the upper frame part 23. Driving means 40 is connected to the transport roller 38 and is configured to control the rotating velocity of said transport roller 38. By rotating the transport roller 38 the endless belt 32 is moved with a velocity corresponding to the rotation velocity of the transport roller 38. The endless belt may be constituted of a material suitable for providing the same velocity at substantially all parts of the endless belt. The endless belt may be made of any suitable material, such as (reinforced) plastics materials, metals, ceramics or the like. The endless belt is selected such that the reference pattern 34 may be reliably transported between free rotating roller 36 and transport roller 38 and the distance between the markers in the reference pattern is constant during the movement including acceleration and deceleration of the reference pattern 34.

In operation the endless belt 32 is moved with a certain velocity by the driving means 40. So the reference pattern 34 is moved with said velocity between the free rotating roller 36 and the transport roller 38 in parallel to the scanning direction of the carriage 11. In the first embodiment illustrated the reference pattern is moving in the direction indicated by arrow 46.

The velocity of the reference pattern 34 with respect to the stationary frame may be determined by any means. In the embodiment of FIG. 2 the velocity of the reference pattern 34 is determined by accurate control of the velocity by driving means 40. The driving means 40 may be configured such that the reference pattern attains a pre-selected velocity. In this embodiment the driving means may comprise an internal encoder and a sensor (not shown). The control unit may be coupled to the internal encoder and sensor of the encoder for determining the driving velocity of the driving means. The control unit 30 based on the determined driving velocity of the driving means may predict the velocity of the reference pattern 34 with respect to the stationary frame 10.

The first sensor 24 is supported by the carriage 11 and is arranged close to the reference pattern 34, such that the sensor is able to sense the reference pattern 34. The carriage 11 is movably arranged in a scanning direction B. The carriage 11 may move in a scanning direction B with a certain velocity by belt drive means 44. Consequently the sensor 24 will move with the same velocity in the scanning direction B. The sensor 24 in operation senses the reference pattern 34. In the illustrated embodiment the carriage 11 and sensor 24 move in the opposite direction of the movement of the reference pattern at the position of the sensor 24. The relative movement of the sensor 24 with respect to the reference pattern 34 is the sum of the movement of the sensor 24 with respect to the stationary frame in direction +x and the movement of the reference pattern 34 with respect to the stationary frame in direction −x. So the relative velocity of the sensor 24 with respect to the reference pattern 34 is higher than the relative velocity of the sensor 24 with respect to the stationary frame. So the sensor 24 senses at a high frequency the markers of the reference pattern 34. The sensor signal provided by the sensor 24 comprises at a corresponding frequency the marker information of the sensed reference pattern 34. The sensor 24 is coupled to a control unit 30. The control unit 30 determines the velocity of the carriage relative to the stationary frame based on the determined velocity of said reference pattern with respect to the stationary frame and based on the sensor signal.

The endless belt 32 of the first embodiment may be moved in operation with a constant velocity and direction by the driving means 40. So the velocity is accurately controlled by said driving means 40.

In an alternative embodiment the movement of the reference pattern 34 with respect to the stationary frame may be adapted relative to the movement of the carriage 11 with respect to said stationary frame 10. In the illustrated first embodiment the carriage may move in reciprocating scanning movements. The carriage may turn at one end of the guide rail and move in the opposite direction. In response to the turning of the carriage the movement of the reference pattern 34 with respect to the stationary frame may also be turned in the opposite direction. So in an embodiment the direction of the movement of the reference pattern is adapted such that it moves in a substantial opposite direction of the scanning carriage 11.

In an alternative embodiment the movement of the reference pattern 34 with respect to the stationary frame may be adapted relative to the estimated velocity of the carriage 11 with respect to said stationary frame 10. For example in a quality printing mode for providing a high print resolution image the velocity of the carriage 11 may be decreased in order to enable a more accurate ink drop positioning process. The reference pattern 34 in this embodiment may move in opposite direction of the moving carriage 11. In order to even further improve the accuracy of the determination of the velocity of the carriage 11 during this printing mode, the velocity of the reference pattern 34 respect to the stationary frame may be increased and maintained at a higher velocity.

Figure 3:
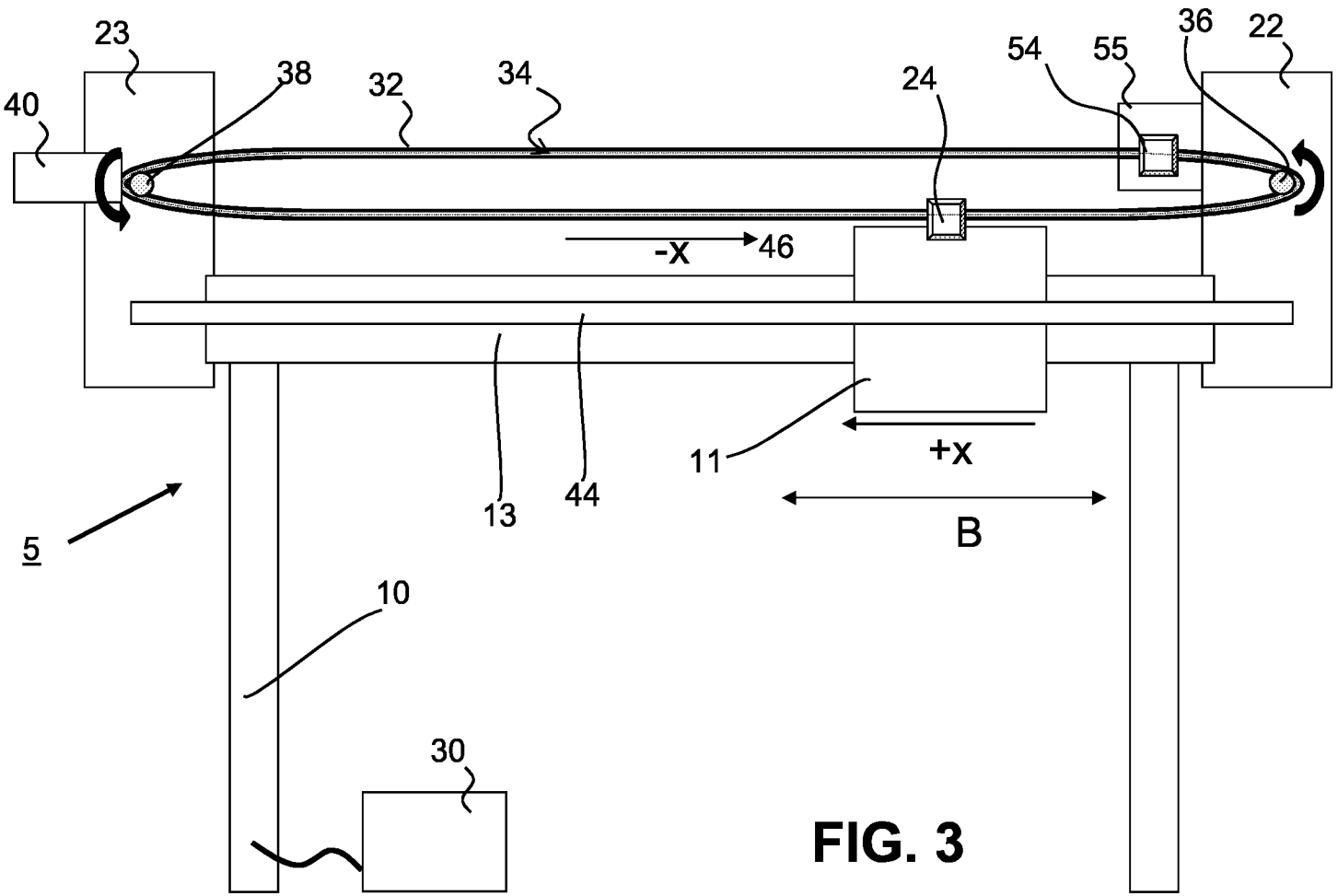
FIG. 3 shows a front schematic view of a second embodiment of the method in accordance with the present invention.

FIG. 3 illustrates a front schematic view of a second embodiment of the method in accordance with the present invention for determining the velocity of a carriage.

In this embodiment a second sensor 54 is arranged close to the reference pattern 34, such that the sensor is able to sense the reference pattern 34. The second sensor 54 is supported by mounting member 55, which is fixed to the stationary frame 10. The second sensor 54 is arranged such that in operation the position of the movable arranged first sensor 24 of the carriage 11 may not interfere with the position of the second sensor 54. The control unit 30 is connected to second sensor 54.

In operation sensor 54 senses the reference pattern 34 and provides a sensor signal to the control unit 30. The control unit 30 may determine the velocity of the said reference pattern based on the sensor signal of sensor 54. As in the first embodiment the control unit 30 may control the movement of the reference pattern 34 with respect to the stationary frame 10 by controlling the driving means 40. The advantage of this embodiment is the direct determination of the velocity of the reference pattern 34. So the driving means 40 in the second embodiment may be less accurate in controlling a velocity of the reference pattern 34.

The second sensor 54 may be arranged to sense the same markers of the reference pattern as the first sensor 24. In an embodiment the first sensor and second sensor may be both an optical sensor and the reference pattern an optical readable pattern. The first sensor and second sensor may be arranged at opposite sides of the reference pattern. The optical readable reference pattern may be optically (semi)-transparent between the markers and both sensors may be configured to sense the same markers of the optical readable reference pattern 34. In the second embodiment the second sensor 54 is positioned at the same side facing the reference pattern as the first sensor 24. This arrangement enables an even better combination of both sensors for sensing the reference pattern 34.

Figure 4A:
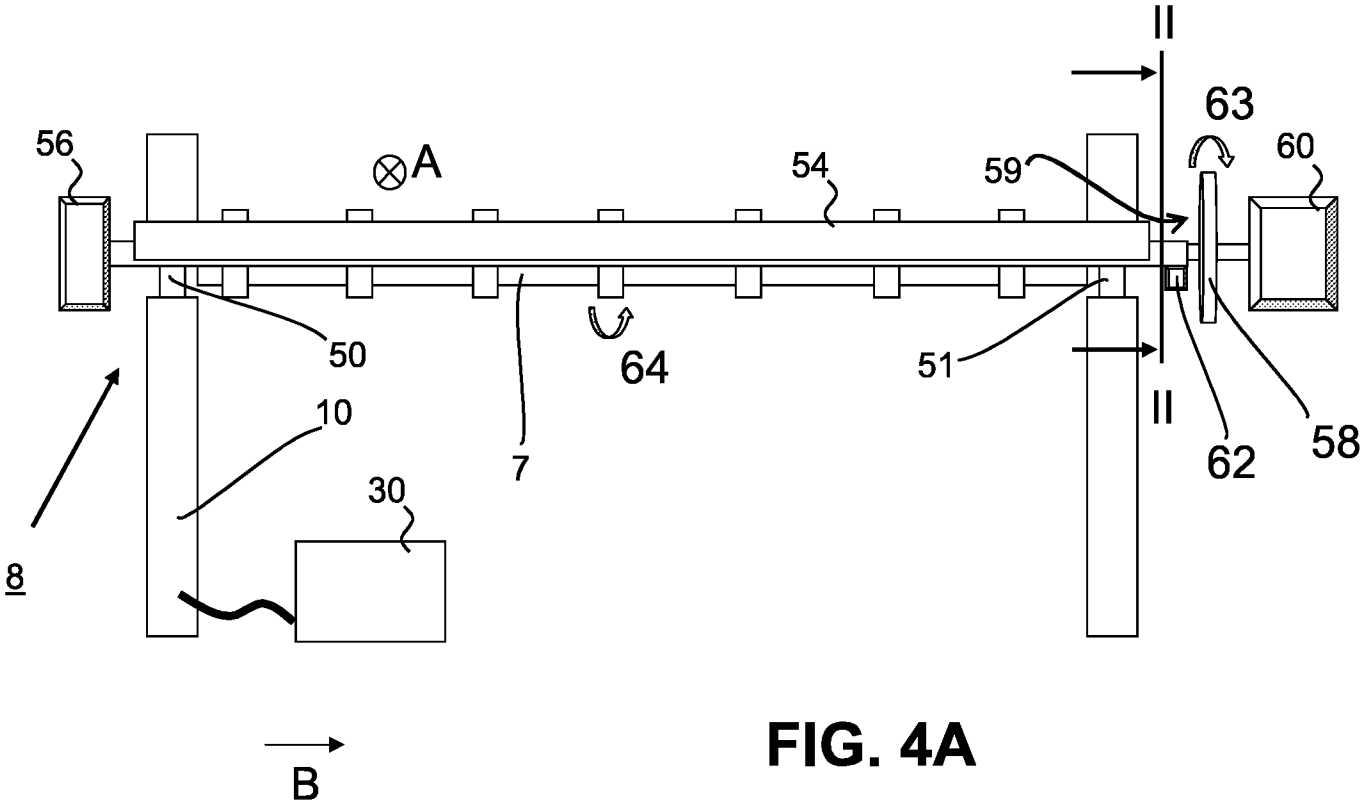
FIG. 4A shows a front schematic view of a third embodiment of a method according to the present invention.

FIG. 4A illustrates a front schematic view of a third embodiment of a method according to the present invention for determining the rotation velocity of a transport roller.

A medium advance means 8 comprises a bearing assembly. The bearing assembly is formed by two bearings 50, 51 which rotatably support a platen 7 between two frame members 48. A sheet support plate 54 is supported at both ends on the two frame members 48 and serves to support a sheet of a recording medium 20 (not shown) which is advanced in a direction A by platen 7, referred to as medium advance direction A. A worm-type drive mechanism 56 for the platen 7 is arranged near the bearing 50. An encoder disc 58 is rotatably arranged near the right bearing 51 and is rigidly connected to encoder driving means 60. The encoder driving means 60 is held stationary with respect to the frame 10. The encoder disc 58 may be—in an embodiment—axial supported by bearing 51. The encoder disc 58 comprises a reference pattern 59.

The encoder driving means 60 is configured to rotatably move encoder disc 58. The encoder driving means 40 may rotate encoder disc 58 with a constant pre-selected velocity. A first sensor 62 is arranged near to the encoder disc 58, such that the sensor is able to sense the reference pattern 59 and is supported by the platen 7. So if the platen 7 rotates, the first sensor 62 rotates with the same rotational velocity as the platen 7.

Figure 4B:
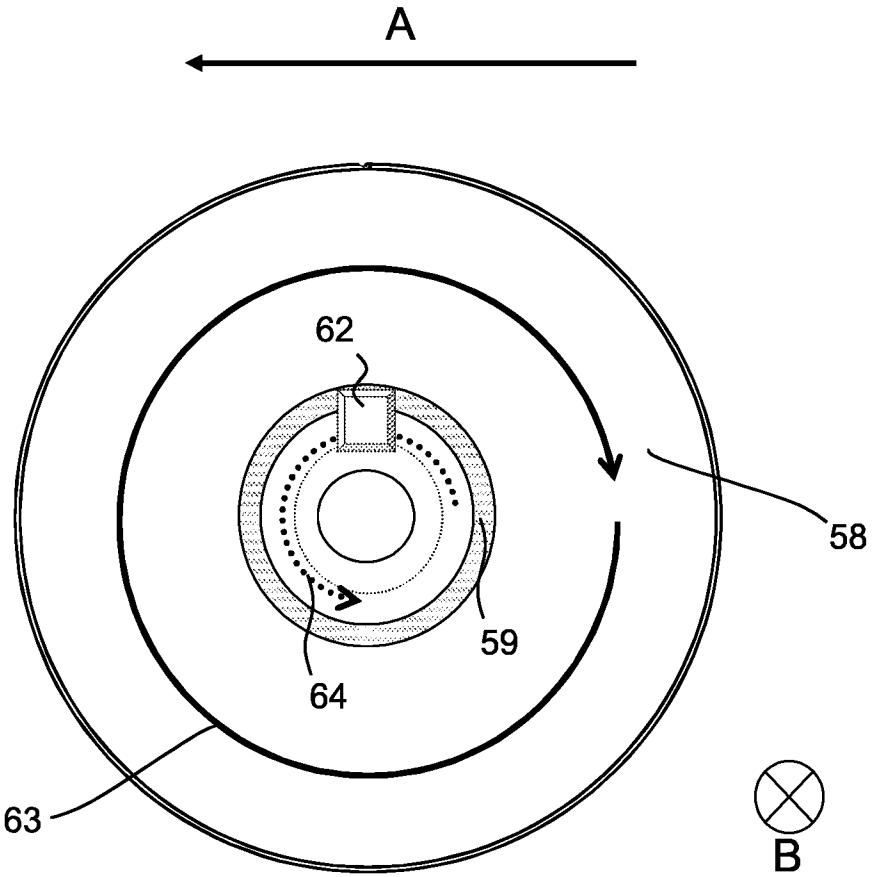
FIG. 4B shows an enlarged side view along the line II-II in FIG. 4A of the third embodiment of a method according to the present invention.

In FIG. 4B illustrates an enlarged side view along the line II-II in FIG. 4A of the third embodiment of a method according to the present invention of the third embodiment of a method according to the present invention for determining the rotation velocity of a transport roller.

The encoder disc 58 according to the third embodiment is constantly rotated in direction of arrow 63. The encoder driving means 60 determines the rotational velocity of encoder disc 58. The rotational velocity of the encoder disc 58 may be maintained at a high rotational velocity compared to the rotational velocity of the platen 7. The reference pattern 59, comprising markers at fixed angles is rotationally arranged on the encoder disc 58.

The platen 7 in operation may mainly move in rotational direction of arrow 64 for moving a recording medium 20 in a direction A. The constant rotational movement 63 is opposite of the direction of the platen 7.

The platen 7 rotates with a certain rotational velocity in direction of arrow 64. The first sensor 62, which is supported by the platen 7, rotates with the same rotational velocity. The first sensor 62 senses the reference pattern 59 and provides a sensor signal to the control unit 30.

In the third embodiment shown in FIG. 4A en 4B, a control unit as described in relation to FIGS. 2 and 3 may be employed for determining the rotational velocity of the platen relative to the stationary frame based on the determined rotational velocity of the encoder disc with respect to the stationary frame and based on the sensor signal.

Figure 5A:
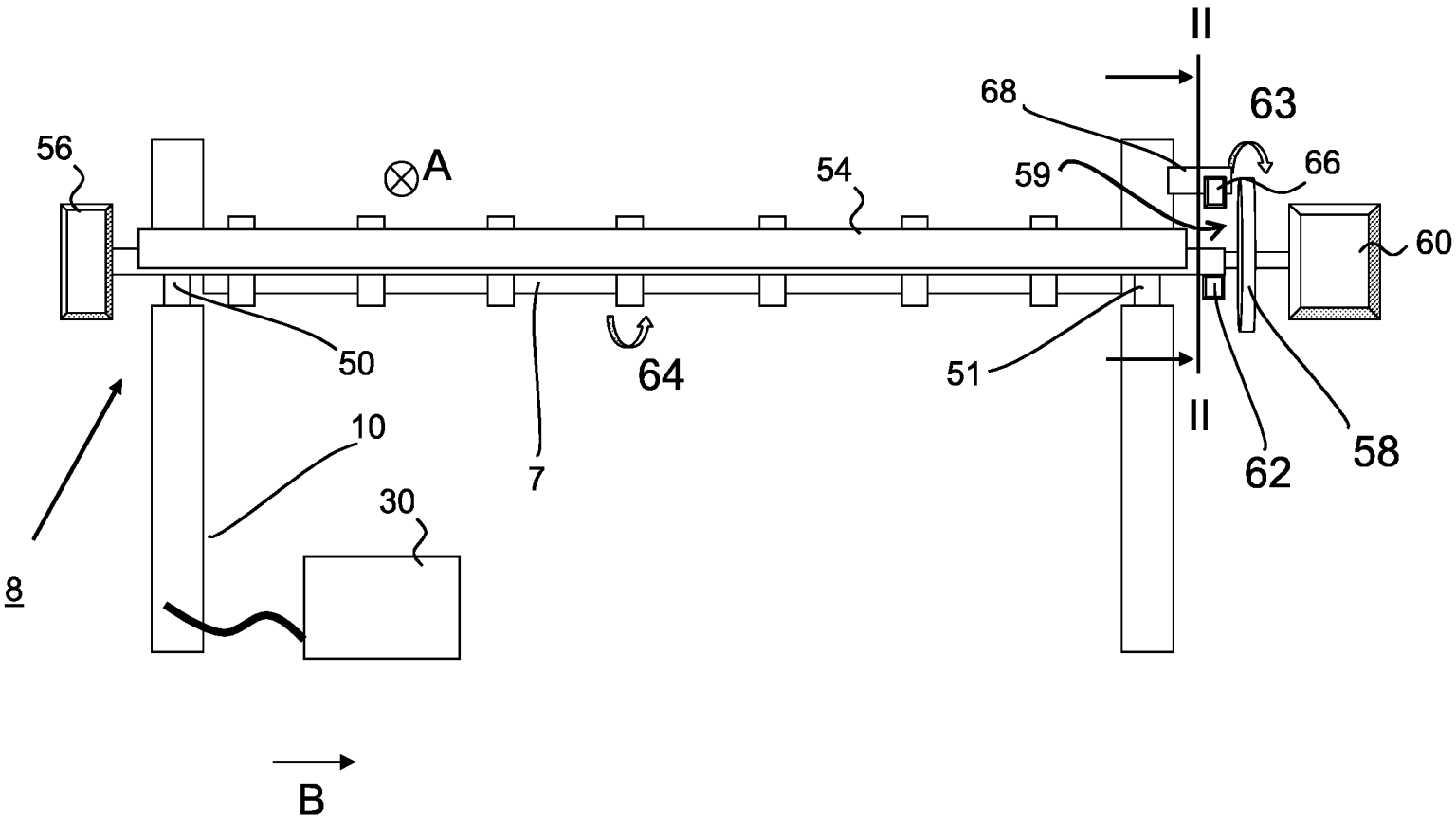
FIG. 5A shows a front schematic view of a fourth embodiment of a method according to the present invention.

FIG. 5A illustrates a front schematic view of a fourth embodiment of a method according to the present invention for determining the rotation velocity of a transport roller. In this embodiment a second sensor 66 is arranged close to the reference pattern 59 such that the sensor is able to sense the reference pattern 59. The second sensor 66 is supported by mounting member 68, which is fixed to the stationary frame 10. The second sensor 66 is arranged such that in operation the position of the rotationally arranged first sensor 62 of the platen 7 may not interfere with the position of the second sensor 66. The second sensor 66 may be arranged on the opposite side of the encoder disc 58. In another embodiment the second sensor 66 may be arranged at the same side of the encoder disc 58 at a different distance from the axis of the platen as the first sensor 58.

The control unit 30 is connected to second sensor 66.

In operation sensor 66 senses the reference pattern 59 and provides a sensor signal to the control unit 30. The control unit 30 may determine the rotational velocity of the said reference pattern based on the sensor signal of sensor 66.

Figure 5B:
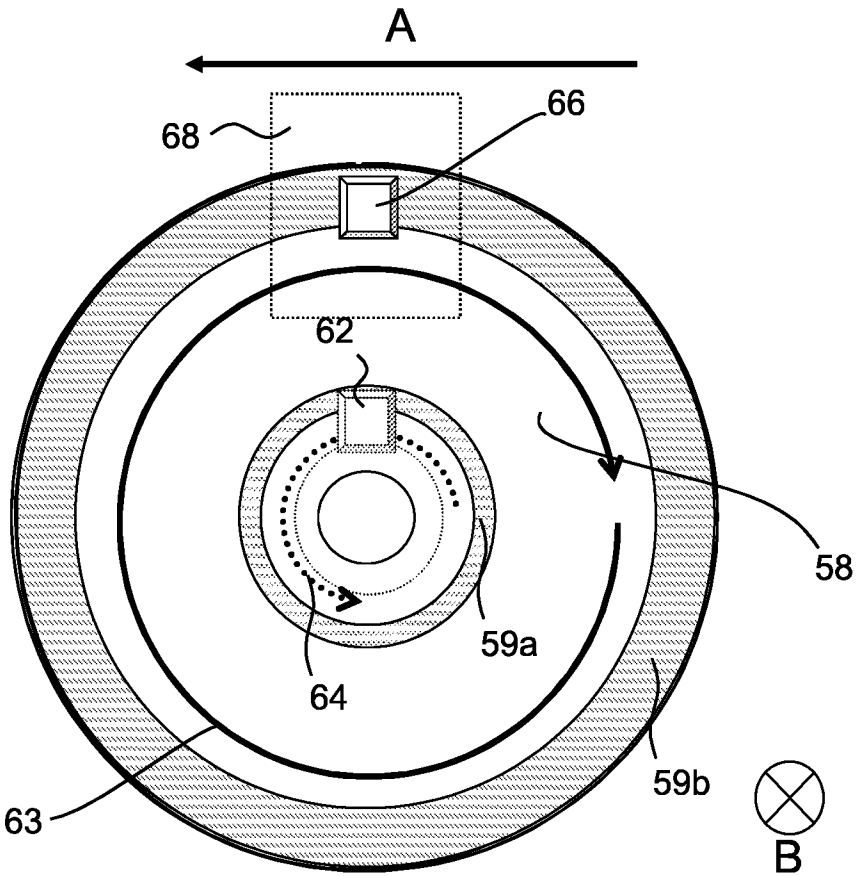
FIG. 5B shows an enlarged side view along the line II-II in FIG. 5A of the fourth embodiment of a method according to the present invention.

FIG. 5B illustrates an enlarged side view along the line II-II in FIG. 5A of the fourth embodiment of a method according to the present invention.

The second sensor 66 may be arranged to sense the same markers of the reference pattern as the first sensor 62. In another embodiment the reference pattern 59 may comprise two sets of markers 59*a* and 59*b*. The markers 59*a* are arranged on the inner circle and comprise a lower resolution than the markers 59*b*, which are arranged on the outer circle of the encoder disc 58. The first sensor 62 may sense the markers 59*a* and the second sensor 66 may sense the markers 59*b*. This embodiment provides improved accuracy for determining the rotational velocity of the platen 7 with respect to the encoder disc 58. The rotational velocity of platen 7 changes fast for a stepwise advancing recording medium 20.

In an embodiment the first sensor and second sensor may be both an optical sensor and the reference pattern an optical readable pattern. In the fourth embodiment the control unit 30 may be coupled to illumination means (not shown) for illuminating the reference pattern. The illuminating means may improve the accuracy of sensing the reference pattern by the optical sensors.

Figure 5C:
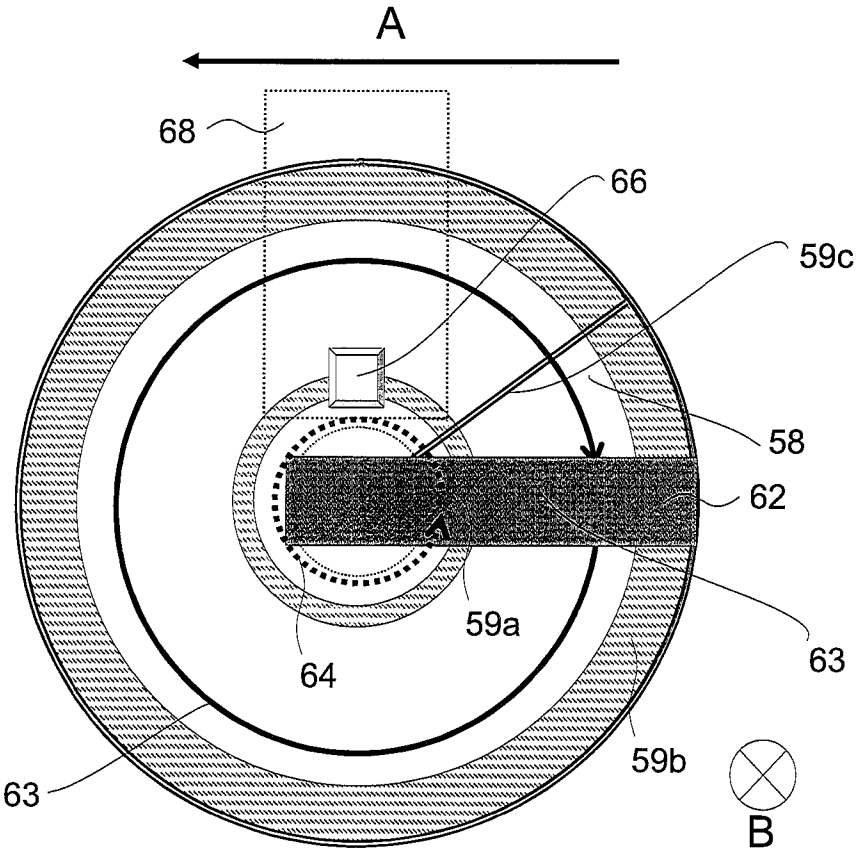
FIG. 5C shows an enlarged side view along the line II-II in FIG. 5A of the fifth embodiment of a method according to the present invention.

FIG. 5C illustrates an enlarged side view along the line II-II in FIG. 5A of the fifth embodiment of a method according to the present invention.

The reference pattern 59 comprises three sets of markers 59*a*, 59*b* and 59*c*. The marker sets 59*a* and 59*b* both comprise a plurality of markers at fixed angle. The markers 59*a* are arranged on the inner circle and comprise a lower resolution than the markers 59*b*, which are arranged on the outer circle of the encoder disc 58. In the fifth embodiment the first sensor is supported by the sensor member 63 and is arranged near the outer markers 59*b*. The first sensor 62 may sense the markers 59*b* and the second sensor 66 may sense the markers 59*a*.

The third set 59*c* comprises one marker, marking a fixed angle position of the encoder disc 58. The third marker 59*c* may be used as a homing point for the determination of a rotational position (i.e. angular position) of the platen 7. The first sensor 62 and second sensor 66 are configured to distinguish the marker 59*c* from the other markers 59*a* and 59*b*. Both sensor provide a sensor signal based on the sensing of markers 59*c* and 59*b*, 59*c*. The sensor signal provides information on both the sensing of the marker 59*c* and the sensing of the markers 59*b*, 59*c*. The control unit 30 is coupled to both sensors 62, 66.

In the method according to the fifth embodiment the control unit 30 is configured to determine the rotational position of the platen 7 based on the sensor signals provided by both sensors 62,66. In a first stage at a certain time t1 the second sensor 66 senses the marker 59*c* and provides a sensor signal to the control unit 30. The marker 59*c* rotates with a constant velocity around the axis of the platen 7. In a second stage at a certain time, characterized by a delta time t1, the second sensor 66 senses the next passing of the marker 59*c*. The second sensor again provides a sensor signal to the control unit 30. The control unit 30 determines the characteristic time constant, delta time t1, based on the subsequent sensor signal in response to the marker 59*c*. The control unit 30 may determine the rotational velocity of the encoder disc based on the characteristic time constant of the marker 59*c* in combination of the sensor signal, indicating the sensing of the marker set 59*a*. So the combination of using markers set 59*a* and 59*c* enables a more accurate determination of the rotational velocity of the encoder disc.

Furthermore in an embodiment the control unit 30 may store the characteristic time constant. The control unit may use the stored time constant to compare next determined time constants. In the fifth embodiment the marker 59*c* rotates with a constant velocity. As a result the characteristic time constant delta t1 is a periodic time constant.

In a third stage at a certain time t2 the first sensor 62 senses the marker 59*c* and provides a sensor signal to the control unit 30. In a fourth stage the control unit determines a time constant t2, based on the sensor signal of the first sensor 62 in response to the marker 59*c*. The control unit 30 may determine the time difference delta t2 between t1 and t2 based on the sensor signals provided by first sensor and second sensor. So the delta t2 is the time difference between the sensing of the marker 59*c* by the second sensor and the first sensor.

The control unit may determine the rotational position of the platen 7 with respect to the position of the frame based on the determined time constant delta 1 of the rotation of the encoder disc, and based on the time difference delta t2.

The method according to the invention enables an accurate step wise movement of the recording medium 20. The start position of a stationary platen 7 is determined by the above indicated steps before starting the rotational movement of the platen 7. The platen 7 is driven by worm-type drive mechanism 56 such that the recording medium is advanced in direction A. During the rotation of platen 7 the angular position of the platen 7 is constantly monitored by using the homing point 59*c* using the method of the fifth embodiment. At a certain moment the rotation of platen 7 is stopped at a desired angular position. After the platen 7 has been halted the constantly rotating encoder disc 58 enables the checking of the resulting angular position of the platen 7. In an embodiment the control unit may check the resulting angular position of the platen 7 and, if desired, e.g. in case a mismatch is determined between the actual position and the desired position, may control the worm-type drive mechanism 56 in order to correct the angular position of platen 7. This method for determining the position of the platen 7 provides an improved step wise advancing of a recording medium 20.

Detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. In particular, features presented and described in separate dependent claims may be applied in combination and any combination of such claims is herewith disclosed.

Further, the terms and phrases used herein are not intended to be limiting; but rather, to provide an understandable description of the invention. The terms "a" or "an", as used herein, are defined as one or more than one. The term plurality, as used herein, is defined as two, or more than two. The term another, as used herein, is defined as at least a second or more. The terms including and/or having, as used herein, are defined as comprising (i.e., open language). The term coupled, as used herein, is defined as connected, although not necessarily directly.

The invention claimed is:

1. A method for determining a velocity of an object in a printing system, the printing system comprising an fixed reference point, a reference pattern, independently movable with respect to said fixed reference point, wherein the object is independently movable with respect to said fixed reference point and with respect to the reference pattern, a first sensor, configured to have substantially the same velocity as said object with respect to said reference pattern and configured such that in operation the reference pattern is sensed by said sensor, comprising the steps of:

a) moving said reference pattern relative to said fixed reference point independent of said object, b) determining the velocity of said reference pattern with respect to said fixed reference point, c) sensing said reference pattern using said first sensor, d) providing a sensor signal based on said sensed reference pattern, and e) determining the velocity of said object relative to said fixed reference point based on the determined velocity of said reference pattern with respect to said fixed reference point, and based on said sensor signal.

2. The method according to claim 1, wherein step a) comprises moving the reference pattern in a substantial linear movement.

3. The method according to claim 1, wherein step a) comprises moving the reference pattern in a rotational movement.

4. The method according to claim 1, wherein step b) comprises providing a second sensor and determining the velocity of said reference pattern with respect to said fixed reference point by said second sensor.

5. The method according to claim 4, wherein the method comprises additional steps f) providing a horning point on said reference pattern, g) sensing the homing position by first and second sensor, and h) determining the position of the object with respect to the fixed reference point.

6. The method according to claim 1, wherein step b) comprises providing driving means for controlling the velocity of said reference pattern with respect to said fixed reference point, wherein the driving means are configured such that reference pattern attains a pre-selected velocity.

7. The method according to claim 1, wherein step a) comprises adapting the movement of said reference pattern with respect to said fixed reference point relative to the movement of the object.

8. The method according to claim 7, wherein step a) comprises moving the reference pattern in a substantial opposite direction of the movement of the object.

9. An apparatus for determining a velocity of an object in a printing system, the apparatus comprising a fixed reference point, a reference pattern, which is independently movable with respect to said fixed reference point and with respect to the object, a first sensor and a control unit, wherein the object is independently movable with respect to said fixed reference point and with respect to the reference pattern, the first sensor being configured to have substantially the same velocity as said object with respect to said reference pattern and configured to sense the reference pattern and provide a sensor signal to the control unit, which control unit is configured to receive and process the sensor signal of the first sensor and thereby determining the velocity of said object relative to said fixed reference point based on the sensor signal of the first sensor and on a determined velocity of the reference pattern with respect to said fixed reference point.

10. The apparatus according to claim 9, wherein said object is movable in a substantial linear movement and said velocity is the velocity in said linear movement.

11. The apparatus according to claim 10, wherein said reference pattern is an endless pattern.

12. The apparatus according to claim 9, wherein said object is rotatable around at least one axes and said velocity is the velocity in said rotational movement.

13. The apparatus according to claim 12, wherein said reference pattern is an endless pattern.

14. The apparatus according to claim 9, wherein a second sensor is provided, which second sensor is stationary with respect to said fixed reference point, and the velocity of said reference pattern with respect to said fixed reference point is determined by said second sensor.

15. The apparatus according to claim 14, wherein said reference pattern comprises a homing point, wherein said horning point is distinguishable from said reference pattern for said first and optionally second sensor.

16. The apparatus according to claim 9, wherein said first sensor is an optical sensor and said reference pattern is an optical readable pattern.

17. The apparatus according to claim 9, wherein said reference pattern comprises a homing point, wherein said homing point is distinguishable from said reference pattern for said first and optionally second sensor.

* * * * *